United States Patent [19]

Ensmann et al.

[11] 4,045,908

[45] Sept. 6, 1977

[54] POWERED VEHICLE TRANSPORT VEHICLE AND TRACK HAVING A WELL THEREIN

[75] Inventors: Burt Ensmann, Flush; Edwin A. Nielsen, Oceanside; Edward Snyder, III, Dix Hills; Frank D. Ventura, Commack, all of N.Y.

[73] Assignee: Ideal Toy Corporation, Hollis, N.Y.

[21] Appl. No.: 650,343

[22] Filed: Jan. 19, 1976

Related U.S. Application Data

[63] Continuation of Ser. No. 494,699, Aug. 5, 1974, abandoned.

[51] Int. Cl.[2] ..... A63H 17/26

[52] U.S. Cl. ..... 46/204; 46/206; 46/216

[58] Field of Search ..... 46/96, 202, 204, 206, 46/249–263; 180/1 C; 74/13, 14

[56] References Cited

U.S. PATENT DOCUMENTS

| | | | |
|---|---|---|---|
| 1,275,754 | 8/1918 | Rockwood | 74/14 |
| 1,495,726 | 5/1924 | Cook et al. | 180/1 C UX |
| 1,602,789 | 10/1926 | Thompson | 46/96 |
| 2,282,745 | 5/1942 | Preston | 180/1 C UX |
| 3,553,885 | 1/1971 | Tazaki | 46/202 X |
| 3,594,951 | 7/1971 | Perhacs | 46/202 X |
| 3,688,436 | 9/1972 | Wakimura | 46/202 X |
| 3,733,894 | 5/1973 | Dahl | 74/14 X |

FOREIGN PATENT DOCUMENTS

| | | | |
|---|---|---|---|
| 2,205,825 | 5/1974 | France | 46/204 |

*Primary Examiner*—F. Barry Shay
*Attorney, Agent, or Firm*—Richard M. Rabkin

[57] ABSTRACT

A toy vehicle game, for use with a powered toy vehicle having at least one driven wheel, includes a transport vehicle which is adapted to receive and support the powered vehicle on an associated track. The transport vehicle has means therein for locating the powered vehicle on the transport vehicle in a predetermined position, and includes at least one track engageable wheel rotatably mounted therein which is located in operative engagement with the driven wheel of the powered vehicle when the powered vehicle is in said predetermined position on the transport vehicle. As a result, the driven wheel of the powered vehicle rotates the track engageable wheel of the transport vehicle in order to propel the transport vehicle.

21 Claims, 5 Drawing Figures

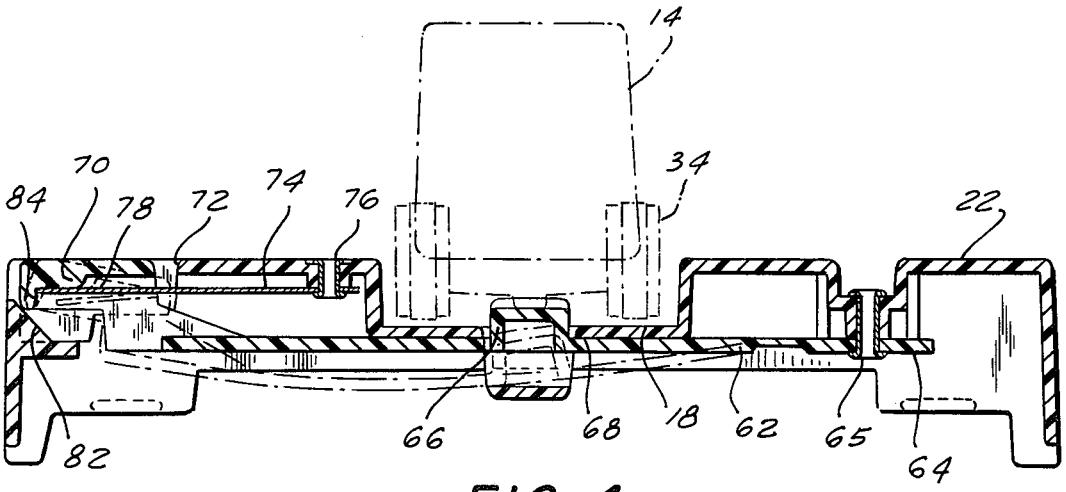
FIG. 4
FIG. 5
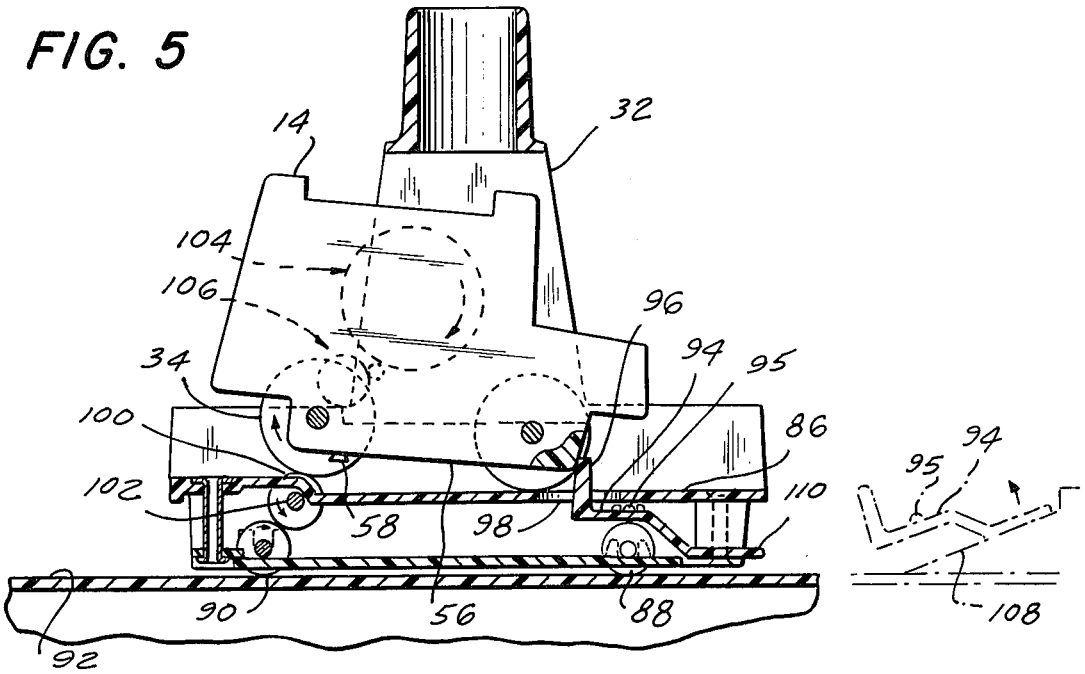

POWERED VEHICLE TRANSPORT VEHICLE AND TRACK HAVING A WELL THEREIN

This is a continuation of application Ser. No. 494,699, filed Aug. 5, 1974, now abandoned.

The present invention relates to a toy vehicle game, and more particularly to a toy in which a powered vehicle is used to drive a second unpowered vehicle.

Numerous types of toy vehicle games have previously been provided in which one or more vehicles move about a track in a race, or stunt-type game. These games often include various control mechanisms in order to affect the movement of the vehicle during the course of the game. However, these games are typically sophisticated in construction and are primarily intended for use by older children and not infants or children of pre-school age.

Accordingly, it is an object of the present invention to provide a vehicle game for use with a powered vehicle, which is suitable for use, by young children.

Another object of the present invention is to provide a vehicle game which is sturdy in construction and relatively inexpensive to manufacture.

A still further object of the present invention is to provide a vehicle game which permits young children to control movement of a powered toy vehicle in a game in a relatively simple manner while maintaining interest in the game for the young child.

In accordance with one aspect of the present invention the toy vehicle game includes a track which is adapted to guide a powered toy vehicle along a vehicle support surface in a predetermined path of travel. The vehicle may be powered in any convenient manner, and preferably contains an inertia or flywheel motor and a gear reduction transmission therein.

The track may include a track section in which an elongated well is formed that extends along a portion of the path of travel of the vehicle. A second vehicle is provided in the game which consists of a transport vehicle positioned in the well and having two pairs of track engaging wheels rotatably mounted therein. The transport vehicle provides a deck or vehicle support platform which is located at substantially the same elevation as the vehicle support surface of the remainder of the track.

The transport vehicle also includes a pair of transmission wheels which are respectively frictionally engaged with the track engaging wheels of the transport vehicle and which extend through the transport vehicle's deck in predetermined positions to respectively engage the driven wheels of the powered toy vehicle. Releaseable stop means are provided in the transport vehicle for selectively preventing movement of the powered vehicle from the deck of the transport vehicle beyond a predetermined position on the deck at which the driven wheels of the toy vehicle will engage the transmission wheels of the transport vehicle. As a result, the power supply of the powered toy vehicle causes the transmission wheels of the transport vehicle to rotate, thereby rotating the track engaging wheels of the transport vehicle and causing the transport vehicle, with the powered toy vehicle thereon, to move along the elongated well of the track. Preferably, the transport vehicle is in the configuration of a ferry boat and the well portion of the track is constructed to simulate open water, thereby giving the child the illusion of having the ferry transport the car from one roadway track section across the water to a second roadway track section.

The above, and other objects, features and advantages of the present invention, will be apparent to those skilled in the art in the following detailed description of an illustrative embodiment of the invention which is to be read in connection with the accompany drawings, wherein.

Figure 1:
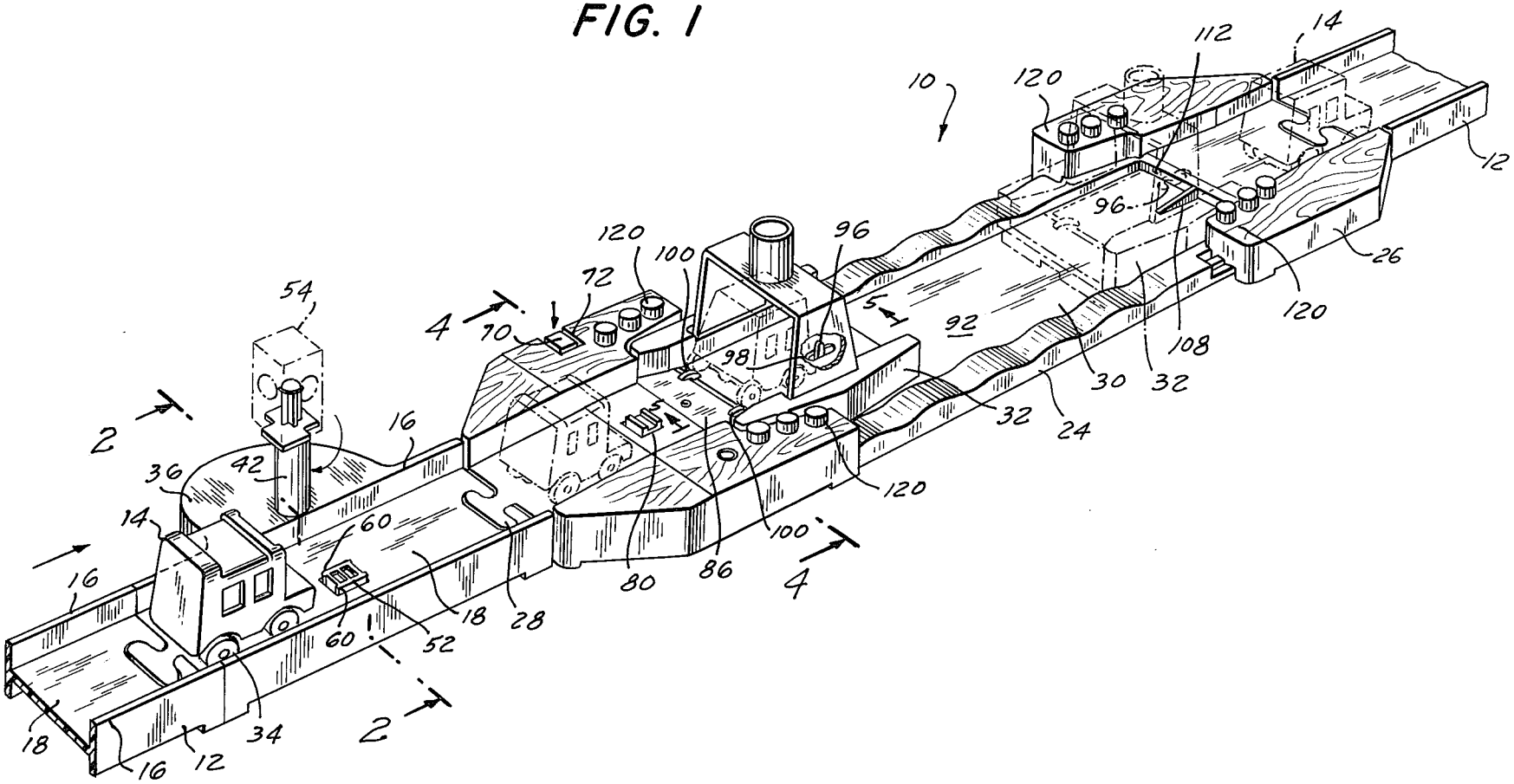
FIG. 1 is a partial perspective view of a toy vehicle game constructed in accordance with one embodiment of the present invention.

and FIGS. 4 and 5 are sectional views taken along lines 4—4 and 5—5 respectively in FIG. 1.

Referring now to the drawing in detail, and initially to FIG. 1 thereof, it will be seen that the toy vehicle game 10 of the present invention consists of an elongated track 12 formed of a plurality of releaseably interconnected track segments, along which a powered vehicle 14 can move. Preferably the track 12 is assembled to form an endless loop along which the vehicle 14 can move, and is provided with side walls 16 which restrain the movement of the toy vehicle along the support surface 18, in a predetermined direction.

In accordance with a feature of the invention, track 12 is provided with specially constructed track sections including a stop light section 20, a loading dock section 22, a simulated water section 24, and an unloading dock section 26. These track sections are interconnected, as illustrated in the drawing, in any convenient manner, preferably by simple male and female constructions 28 at their opposed ends, so that they are readily assembled by pre-school age children.

The simulated water section 24 of the track 12 provides a well 30 therein having a base or support surface 92 located below the level of the support surface 18 of the remainder of the track. A transport vehicle 32, which preferably is formed as a simulated ferry boat, is adapted to move along this well section of the track. In the play of the game the child permits the powered vehicle 14 to move along track 12 from left to right, as seen in FIG. 1, and can stop the toy vehicle at the stop light section 20, if desired. Thereafter, the child can permit the vehicle to continue moving onto the loading dock section 22, at which the vehicle can again be stopped, as described more fully hereinafter. The ferry boat or transport vehicle 32, if not in position at the loading dock 22, is moved into position by the child, who then permits the toy vehicle to move from the loading dock onto the ferry boat. As described hereinafter, the powered toy vehicle 14 moves onto the ferry boat and its driven wheels cause the ferry boat 32 to move from the loading dock, through the well 30 in track section 24, to the unloading dock 26, at which point further movement of the ferry boat is stopped and the vehicle 14 is free to continue movement onto the unloading dock 26 and the remainder of the track 12.

As mentioned, the powered toy vehicle 14 can take any desired form and can be powered in any convenient manner, such as for example by a spring wound motor, or a bettery driven electric motor. However, since the toy of the present invention is primarily intended for pre-school age children, a flywheel or inertia motor is used to power the two rear wheels 34 of vehicle 14, through a gear reduction transmission system which will permit the vehicle to move at low speed over long distances. With this type of drive arrangement, it is preferred that the structures used in the stop light track section 20 and the loading dock section 24 be arranged to stop the vehicle with its rear drive (or driven) wheels out of engagement with the track, to permit the wheels and thus the flywheel motor to continue turning without interruption. It will be appreciated that if the vehicle were physically stopped with its rear wheels 34 engaged with the track, the rotation of the flywheel motor would be affected and/or stopped.

The stop light track section 20 provides a continuation of the track support surface 18 and extensions of the side walls or guides 16 of the track. In addition, the stop light track section includes an enlarged housing 36 extending therefrom which contains a rotatable circular cam member 38, as seen in detail in FIGS. 2 and 3. Cam 38 is rigidly secured to a vertically extending post 40 rotatably mounted in the stanchion 42 of housing 36, and has four cam surfaces 44, 46 formed in an annular array thereon. The cam surfaces 46 consist of "rises" in cam plate 38 while the surfaces 44 comprise "recesses" formed therein which are connected to the rises 44 by transition, inclined planes 48.

Figure 2:
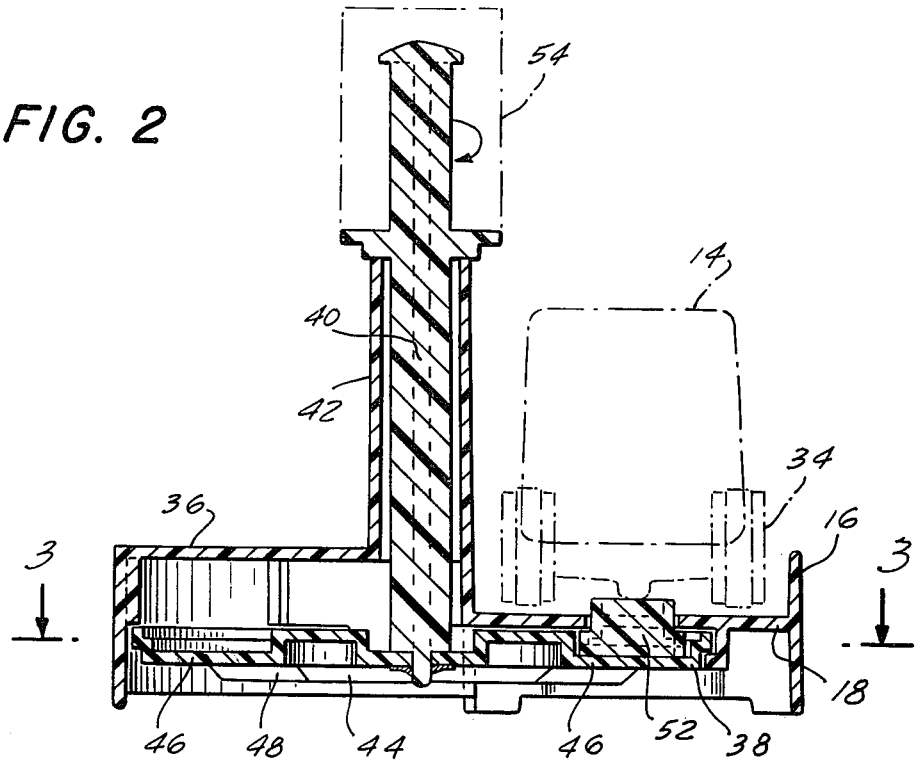
FIG. 2 is a sectional view taken along line 2—2 in FIG. 1.
Figure 3:
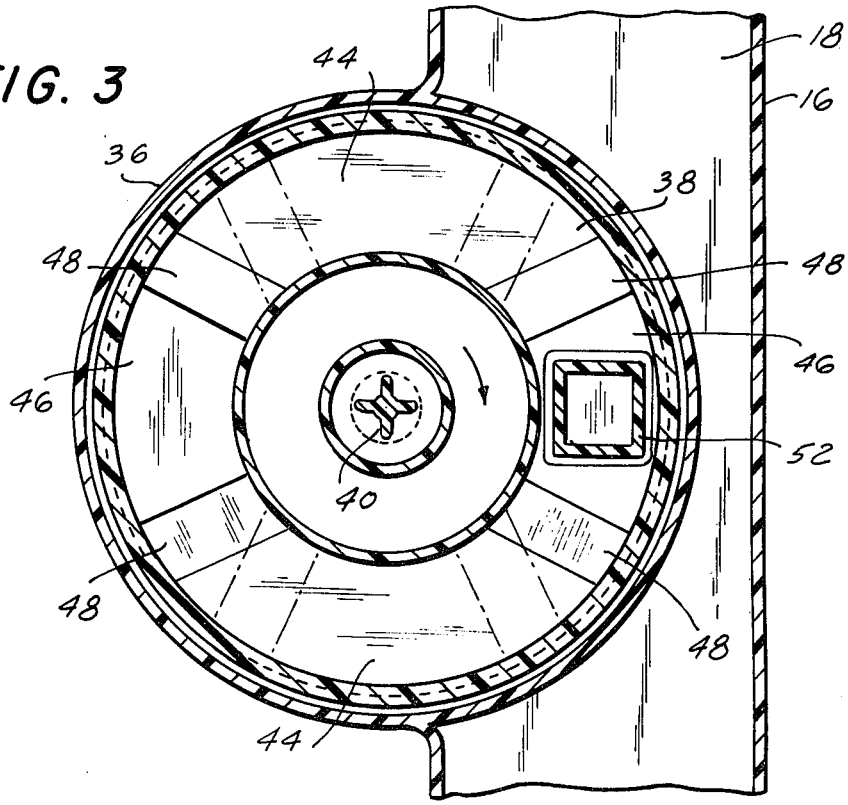
FIG. 3 is a sectional view taken along line 3—3 in FIG. 2.

Cam plate 38 is arranged so that a portion of the plate extends below the vehicle support surface 18 of track section 20. This support surface has an aperture 50 formed therein through which a cam member or button 52 extends. This cam member rides on the horizontal surface of cam plate 38, as seen in FIG. 2. As will be appreciated, by rotating post 40, the child can place the different cam sections 44, 46 of cam plate 38 in engagement with cam member 52. When a riser portion 46 of the cam plate is below button 52, the button is held exposed through the track opening 50 for engagement with the vehicle 14, to stop the vehicle as described hereinafter. On the other hand, when the post 40 is rotated to position a recess cam portion 44 below the button 52, the button moves downwardly under the influence of gravity and is thereby lowered sufficiently so as not to interfere with the travel of vehicle 14.

It is contemplated that the post 40 can have a removable cap structure 54 or the like mounted at its upper end, having the configuration of a stop light including red and green lights of buttons thereon arranged to correspond to the portion of the cam 38 below button 52 in any particular position of the cam.

As seen in FIG. 5, toy vehicle 14 has a solid base 56 which preferably is inclined downwardly slightly from the front of the vehicle towards the rear, at which stop projection 58 is formed. By this construction, as vehicle 14 approaches the stop light track section 20, with the cam member 52 in its up position on the riser portion 46 of cam plate 38, the forward end of the vehicle rides over the curved leading edges 60 of the button 52 and the vehicle rises onto the button. Ultimately, because of the inclined configuration of the base of the vehicle, and the fact that the cam member 52 extends above the vehicle support surface 18 a distance greater than the height of the rear axle of the vehicle above the support surface, the rear wheels of the vehicle rise off and become disengaged with the track surface 18. As a result, movement of the vehicle 14 ceases, although the rear wheels 34 thereof continue to turn. The stop 58 on the bottom of the vehicle is provided to insure that the vehicle is positively stopped against the cam member 52 in the event that its inertia or momentum would tend to cause the vehicle to coast on its front wheels past the stop member. However, the vehicle usually will simply stop immediately, upon the removal of its rear wheels from engagement with the track surface.

When the player desires to allow the vehicle 14 to continue along its path of travel, he simply rotates the post 40 until a recess portion 44 of cam plate 38 is moved into position below the cam member 50, thereby lowering the vehicle with respect to the track and causing the rear wheels 34 thereof to engage the track support surface 18. Since the rear wheels 34 are continuously rotating under the influence of the flywheel motor, the vehicle then commences to proceed along its path of travel onto the loading dock track section 22. This track section also contains a vehicle stop member which is adapted to stop the vehicle in a fixed position with its rear driven wheels out of engagement with the track.

As seen most clearly in FIG. 4, the loading dock track section 22 includes a flexible bar or lever 62 mounted below the track support surface 18 of the track section. On end, 64, of lever 62 is rigidly secured to the unloading dock by a rivet 66 or the like. The central portion of the lever includes an enlargement 66 which extends through an aperture 68 in the vehicle support surface 18 of this track section. This enlargement performs substantially the same function as the cam member 52 previously described. The opposite end of the lever 62 has a finger tab 70 formed therein which extends through an aperture 72 adjacent the edge of the loading dock. This finger tab is biased upwardly into the solid line position illustrated in FIG. 4 by a metal leaf spring 74 which is secured at one end to the loading dock by a rivet 76 and which engages against the lower side of the finger tab 70 at its opposite end 78.

In the normal configuration of the bar 62, the bar maintains its straight configuration, shown in solid lines in FIG. 4, with the enlargement 66 extending through the aperture 68. As vehicle 14 approaches the enlargement or stop 66, its front end rides over the curved forward edges 80 of the enlargement and the vehicle rides up on the enlargement until the rear wheels 34 thereof move out of engagement with the track. At this point the vehicle movement is stopped. Again, in the event the vehicle movement is at a substantial speed much that its momentum would tend to carry the vehicle off of the stop, the stop member 58 on the bottom of the vehicle provides a positive engagement against the enlargement 66 to limit movement of the vehicle.

With the vehicle stopped in this position on the loading dock, the child can move the transport vehicle 32 into position against the loading dock, if the transport vehicle or ferry is not already in that position. Once the ferry is properly positioned the child can, if he wishes, release the vehicle from the enlargement 66 and permit the vehicle to move onto the ferry. This is accomplished by simply depressing the finger tab 70 of bar 62. Downward pressure against this end of the lever moves it against the bias of leaf spring 74 and into engagement with an inclined cam surface 82 formed in the loading dock track section. Engagement of the edge 84 of the finger tab against cam surface 82 causes the bar to bend into its dotted line, since the cam surface 82 causes the finger button to move slightly toward the right in FIG. 4, allowing the bar to bend. Bending of the bar in this manner causes the enlargement 66 to be moved downwardly, into its dotted line position, out of engagement with the bottom of the vehicle, permitting the rear wheels 34 of the vehicle to engage the track surface 18 and continue its forward progress.

As mentioned, the transport vehicle or ferry 32 is adapted to move within the well 30 of the simulated water track section 24. The ferry includes a deck or vehicle support platform 86 which is located to be generally in horizontal alignment with the track support surface 18 of the loading dock 22 and the corresponding track support surface 18 of the unloading dock 26 when the ferry is adjacent either of these docks. This arrangement permits the vehicle to move freely onto and off of the ferry. Thus, once the vehicle 14 is released from the stop 66 at the loading dock, it moves onto the ferry's deck 86.

The ferry 32 includes front and rear pairs of track engaging wheels 88, 90 which are preferably formed integrally with their axles and rotatably mounted in the base of the ferry in any convenient manner in order to permit the ferry to roll along the base 92 of the well 30. A releasable stop member 94 is provided in the ferry 32 and consists of an elongated lever pivotally mounted within the ferry housing intermediate its ends by a pair of integrally formed pivot pins 95 (only one of which is seen in the sectional view of FIG. 5). One end 96 of lever 94 provides an abutment arm that extends through an opening 98 in the deck 86.

Lever arm 94 is of predetermined configuration such that it will normally remain in the solid line position shown in FIG. 5 with the abutment arm 96 extending through aperture 98, due to its own weight distribution. In this position, the abutment arm serves to stop the vehicle and its movement along the deck 86 in a predetermined position.

In order to utilize the driving force of the drive wheels 34 in the toy vehicle 14, the ferry is provided with a pair of transmission wheels 100 which are integrally formed with their axle 102. These wheels can be of similar construction to the track engaging wheels 90 and are rotatably mounted transversely of the ferry in any convenient manner. The wheels extend through the deck 86, (see FIG. 1) at predetermined locations with respect to the stop arm 96, so that when the vehicle 14 is stopped on deck 86 its rear wheels 34 engage the transmission wheels 100. The position of axle 102 is selected such that the wheels 100 will simultaneously engage the rear track engaging wheels 90 and the driven wheels 34 of vehicle 14. In this manner, the power derived from the vehicle's flywheel motor 104 (shown schematically is dotted lines in FIG. 5), is utilized, through the transmission 106 of the vehicle and its driven wheels 34, to rotate the transmission wheels 100 and thus the track engaging wheels 90 of the ferry in the driving direction of the vehicle.

Accordingly, it will be appreciated that once the vehicle is released from the loading dock 22 and moves onto the ferry 32, its movement is stopped by the abutment arm 96 of lever 94, and its rear wheels serve to transmit power to the rear wheels 90 of the ferry, causing the ferry to move from the loading dock 33 towards the unloading dock 26. As the ferry approaches the unloading dock, the lever 94 is pivoted, to move its abutment arm 96 out of engagement with the vehicle 104, thereby freeing the vehicle to move onto the unloading dock. This is accomplished by the provision of an inclined cam plate 108 integrally formed on the base 92 of well 30 (see FIG. 1). As the ferry approaches the unloading dock 26, the arm 110 of lever 94 will engage the cam 108 and ride along the inclined surface of the cam. In this manner, the cam causes the lever 94 to pivot in a counterclockwise direction as seen in FIG. 5 in phantom lines, lowering the abutment arm 96 through opening 98. This movement of the lever 94 frees the vehicle 14 from engagement with the abutment arm and permits the vehicle to move off of the ferry onto the unloading dock.

It is noted that the end wall 112 of the well 30 provides a step for the transport vehicle, which prevents further movement of the vehicle in the driving direction. Thus rotation of the track engaging wheels 90 is stopped, and the power supplied by the flywheel 104 to the vehicle's rear wheels 34 is utilized to drive the vehicle off of the ferry and onto the unloading dock, whereupon the vehicle continues its movement about the track 12.

Although the toy vehicle game 10 has been described above as including the simulated water track section 24, it is contemplated that the game can be provided without this track section. In this embodiment the ferry 32 would simply be supported on and move along the table or floor surface on which the game is placed between the spaced dock sections 22, 26. It has been found that the ferry 32 will move in a substantially straight line under the drive from vehicle 14, so that the provision of a guide well 30 is not a necessity. The operation of the toy would be the same as that described above with the exception that the ferry's movement would be unguided. Any deviation of the ferry from straight line movement over the short space between dock sections 22, 26 would be accommodated and compensated for by the diverging arm portions 120 of the dock section which will guide the ferry into the proper position adjacent to and in alignment with the vehicle support surface 18 of the dock sections. In this case however the cam plate 108 would be formed on the end of dock section 26 to pivot lever 94 as described above.

Accordingly, it will be appreciated that a relatively simply constructed toy vehicle game has been provided which is suitable for use by small children. The game is extremely durable in construction using relatively few moving parts whose operation is simple enough to be easily controlled by pre-school age children. Moreover, these operations provide control of the movement of the toy vehicle, without affecting the drive to the vehicle's rear wheels or the rotation of the flywheel motor in the vehicle. In addition, the game provides interest for the child in that it simulates the use of a powered ferry to move the toy vehicle or car from one position to another along the track; and this is accomplished without the use of any additional motors or power supply for the ferry, but rather the power supply of the vehicle itself is used to effect this end.

Although an illustrative embodiment of the present invention has been described herein in detail with reference to the accompanying drawings, it is to be understood that the invention is not limited to that precise embodiment, and that various changes and modifications may be effected therein by one skilled in the art without departing from the scope or spirit of this invention.

What is claimed is:

1. A toy comprising, in combination, a powered toy vehicle having a power source contained therein and at least one driven wheel, driven by said power source for driving against a supporting surface to propel the powered vehicle thereover, and a transport vehicle including a frame, said frame having a support surface comprising means for supporting said powered vehicle thereon; and releasable stop means mounted in said frame for selectively preventing movement of said powered vehicle beyond a predetermined position on said support surface, said frame including at least one pair of drivingly engaged wheels rotatably mounted therein and located in direct peripheral engagement with each other; one of said engaged wheels located in said frame to engage the driven wheel of said powered vehicle when the latter is in said predetermined position, to be driven by said driven wheel, and the other of said engaged wheels being at least partially exposed in said frame to engage the surface on which the transport vehicle is placed, whereby the driven wheel of the powered vehicle directly drives said one engaged wheel to cause said other of the engaged wheels to propel the frame in the driving direction of the powered vehicle.

2. The toy vehicle as defined in claim 1 including a track defining a vehicle support surface and a path of travel for said powered vehicle, said track including a track section having an elongated well formed therein along said path of travel and having first and second end portions; said transport vehicle being located in said well with the support surface thereof located at substantially the same elevation as the powered vehicle support surface provided by the remainder of the track whereby when said transport vehicle is located adjacent one end of said well a powered vehicle on said track support surface adjacent said one end can move directly onto the support surface of the frame.

3. The toy as defined in claim 2 wherein said track includes releasable stop means for selectively stopping said powered vehicle adjacent said one end of said well.

4. The toy as defined in claim 3 wherein said powered vehicle is driven by an inertia motor and said releasable stop means on the track comprises means for stopping the powered vehicle with its driven wheel out of engagement with the track to allow continued operatoon of the inertia drive motor in the vehicle.

5. A toy for use with a powered toy vehicle having at least one driven wheel for driving against a supporting surface to propel the powered vehicle thereover, said toy including a transport vehicle comprising a frame having a support surface comprising means for supporting said powered vehicle thereon and releasable stop means for selectively preventing movement of said powered vehicle beyond a predetermined position on said support surface; said frame including at least one pair of drivingly engaged wheels rotatably mounted thereon and located in peripheral engagement with each other; one of said engaged wheels being located to engage the driven wheel of said powered vehicle when the latter is in said predetermined position, and the other of said engaged wheels being at least partially exposed in said frame to engage the surface on which the transport vehicle is placed, whereby the driven wheel of the powered vehicle drives said one engaged wheel to cause said other of the engaged wheels to propel the transport vehicle in the driving direction of the powered vehicle; and a track portion along which the powered toy vehicle can move, including means for releasing said stop means in response to arrival of said transport vehicle at a predetermined position with respect to said track portion, thereby freeing the powered vehicle and allowing it to move off of the transport vehicle and onto said track.

6. The toy as defined in claim 5 wherein said stop means comprises a lever pivotally mounted in said frame having a stop abutment arm for engaging a powered toy vehicle on said support surface preventing movement of the powered toy vehicle in a first position of the lever and a release arm exposed through said frame; said releasing means comprising a cam surface located on said track portion for engaging said release arm as said transport vehicle approaches its predetermined position and pivoting said lever from its first position to a second position wherein said abutment arm is out of engagement with said powered toy vehicle.

7. The toy as defined in claim 6 wherein said frame has the general configuration of a ferry boat.

8. The toy as defined in claim 7 wherein said track portion includes guide means limiting the path of travel of the transport vehicle under the influence of said powered vehicle to a predetermined direction.

9. A toy for use with a powered toy vehicle having at least one driven wheel for driving against a supporting surface to propel the powered vehicle thereover, said toy including a transport vehicle comprising a frame having a support surface comprising means for supporting said powered vehicle thereon and releasable stop means for selectively preventing movement of said powered vehicle beyond a predetermined position on said support surface; said frame including at least one pair of drivingly engaged wheels rotatably mounted thereon and located in peripheral engagement with each other; one of said engaged wheels being located to engage the driven wheel of said powered vehicle when the latter is in said predetermined position, and the other of said engaged wheels being at least partially exposed in said frame to engage the surface on which the transport vehicle is placed, whereby the driven wheel of the powered vehicle drives said one engaged wheel to cause said other of the engaged wheels to propel the transport vehicle in the driving direction of the powered vehicle; a track defining a vehicle support surface and a path of travel for said powered vehicle, said track including a track section having an elongated well formed therein along said path of travel and having first and second end portions; said transport vehicle being located in said well with the support surface thereof located at substantially the same elevation as the powered vehicle support surface provided by the remainder of the track whereby when said transport vehicle is located adjacent one of said well a vehicle on said track support surface adjacent said one end can move directly onto the support surface of the frame; said track section including, at the second end thereof, means for releasing the vehicle stop means in said frame as said transport vehicle approaches said second end under the drive of said powered vehicle, thereby freeing the powered vehicle and allowing it to move off of the transport vehicle.

10. A toy for use with a powered toy vehicle having a pair of driven rear wheels for driving against a supporting surface to propel the powered toy vehicle thereover, said toy including a track providing a vehicle support surface defining a path of travel for such vehicles, said track including a track section having an elongated well formed therein extending along a portion of said path of travel, a transport vehicle positioned in said well and having two pairs of track engaging wheels rotatably mounted thereon and a vehicle support platform located at substantially the same elevation as the vehicle support surface of said track, said transport vehicle including a pair of transmission wheels rotatably mounted thereon and respectively frictionally engaged with the wheels of one of said pair of track engaging wheels and which extend through said support platform in predetermined positions to respectively engage the driven wheels of the powered toy vehicle, and releasable stop means mounted in said transport vehicle for selectively preventing movement of said powered toy vehicle from the track support surface onto the transport vehicle beyond a predetermined position on the support platform of the transport vehicle at which the driven wheels of the powered toy vehicle engage the transmission wheels of the transport vehicle, thereby causing the transmission wheels and said one pair of track engaging wheels to rotate and move the transport vehicle, and powered toy vehicle thereon, along said elongated well.

11. The toy as defined in claim 10 wherein said powered toy vehicle moves along said track in a predetermined direction of travel to enter said transport vehicle at one end of said well and leave the transport vehicle at the other end of the well, said transmission wheels being mounted in said transport vehicle in a predetermined position with respect to said one pair of track engaging wheels to cause said track engaging wheels to rotate in the same direction as the driven wheels of the powered toy vehicle to cause said transport vehicle to traverse from said one side of the well to the other in the direction of travel of the powered toy vehicle.

12. The toy as defined in claim 11 wherein said track includes releasable stop means for selectively stopping said powered vehicle adjacent said one end of said well, before the powered toy vehicle moves onto said transport vehicle.

13. The toy as defined in claim 12 wherein said powered vehicle is driven by an inertia motor and said releasable stop means on the track comprises means for stopping the powered toy vehicle with its driven wheels out of engagement with the track to allow continued operation of the inertia drive motor in the vehicle.

14. A toy for use with a powered toy vehicle having a pair of driven rear wheels for driving against a supporting surface to propel the powered toy vehicle thereover, said toy including a track providing a vehicle support surface defining a path of travel for such vehicles, said track including a track section having an elongated well formed therein extending along a portion of said path of travel, a transport vehicle positioned in said well and having two pairs of track engaging wheels rotatably mounted thereon and a vehicle support platform located at substantially the same elevation as the vehicle support surface of said track, said transport vehicle including a pair of transmission wheels rotatably mounted thereon and respectively frictionally engaged with the wheels of one of said pairs of track engaging wheels and which extend through said support platform in predetermined positions to respectively engage the driven wheels of the powered toy vehicle, and releasable stop means mounted in said transport vehicle for selectively preventing movement of said powered toy vehicle from the track support surface onto the transport vehicle beyond a predetermined position on the support platform of the transport vehicle at which the driven wheels of the powered toy vehicle engage the transmission wheels of the transport vehicle, thereby causing the transmission wheels and said one pair if track engaging wheels to rotate and move the transport vehicle, and powered toy vehicle thereon, along said elongated well; said powered toy vehicle moving along said track in a predetermined direction of travel to enter said transport vehicle at one end of said well and leave the transport vehicle at the other end of the well, said transmission wheels being mounted in said transport vehicle in a predetermined position with respect to said one pair of track engaging wheels to cause said track engaging wheels to rotate in the same direction as the driven wheels of the powered toy vehicle to cause and transport vehicle to traverse from said one side of the well to the other in the direction of travel of the powered toy vehicle; said well including guide means for limiting movement of said transport vehicle to said predetermined path of travel and means adjacent said other end of the well for releasing said stop means when said transport vehicle reaches a predetermined position along the well.

15. The toy as defined in claim 14 wherein said other end of the well includes means for preventing further movement of the transport vehicle along said path of travel when said stop means is released and said support platform is adjacent the vehicle support surface of the adjacent portion of the track whereby movement of the transport vehicle is stopped and the powered vehicle is freed to continue moving along the track.

16. A toy for use with a powered toy vehicle having a pair of driven rear wheels for driving against a supporting surface to propel the powered toy vehicle thereover, said toy including a track providing a vehicle support surface defining a path of travel for such vehicles, said track including a track section having an elongated well formed therein extending along a portion of said path of travel, a transport vehicle positioned in said well and having two pairs of track engaging wheels rotatably mounted thereon and a vehicle support platform located at substantially the same elevation as the vehicle support surface of said track, said transport vehicle including a pair of transmission wheels rotatably mounted thereon and respectively frictionally engaged with the wheels of one of said pairs of track engaging wheels and which extend through said support platform in predetermined positions to respectively engage the driven wheels of the powered toy vehicle, and releasable stop means mounted in said transport vehicle for selectively preventing movement of said powered toy vehicle from the track support surface onto the transport vehicle beyond a predetermined position on the support platform of the transport vehicle at which the driven wheels of the powered toy vehicle engage the transmission wheels of the transport vehicle, thereby causing the transmission wheels and said one pair of track engaging wheels to rotate and move the transport vehicle, and powered toy vehicle thereon, along said elongated well; said powered toy vehicle moving along said track in a predetermined direction of travel to enter said transport vehicle at one end of said well and leave the transport vehicle at the other end of the well, said transmission wheels being mounted in said transport vehicle in a predetermined position with respect to said one pair of track engaging wheels to cause said track engaging wheels to rotate in the same direction as the driven wheels of the powered toy vehicle to cause said transport vehicle to traverse from said one side of the well to the other in the direction of travel of the powered toy vehicle; said releasable stop means comprising a lever pivotally mounted in said transport vehicle and having a stop arm for engaging the powered toy vehicle on the support platform to prevent movement of the powered toy vehicle in a first position of the lever and a release arm, exposed externally of said transport vehicle and means in said well for releasing said release arm, comprising a cam surface located in said well for engaging said release arm as the transport vehicle approaches its predetermined position to pivot the lever from its first position to a second position wherein said stop arm is out of engagement with the powered toy vehicle.

17. A toy for use with a powered toy vehicle having a plurality of wheels, a power source, and a rotary drive train for the vehicle including at least one of said wheels; said toy including a transport vehicle having first and second open end portions, a powered vehicle support surface extending between said open end portions, at least one drive wheel for drivingly engaging the surface on which the transport vehicle is placed and drive transmission means for operatively engaging a predetermined portion of said powered vehicle's rotary drive train to transmit power from said drive train to at least one drive wheel of the transport vehicle when the powered vehicle is in a predetermined position on said support surface; a track defining a vehicle support surface and a path of travel for said powered vehicle, said track including a track section having an elongated well formed therein along said path of travel and having first and second end portions; said transport vehicle being located in said well with the support surface thereon located at substantially the said elevation as the powered vehicle support surface provided by the remainder of the track, whereby when said transport vehicle is located in said well with its first open end portion adjacent said first end portion of the well, a powered vehicle on the track support surface adjacent said first end portion of the well can move directly onto the support surface of the transport vehicle; said transport vehicle including means for stopping said powered vehicle in said predetermined position with said powered vehicle's rotary drive train engaged with said transmission means to drive the at least one drive wheel of the transport vehicle and move the transport vehicle from said first end portion of the well to said second end portion; said track section including means adjacent the second end portion of the well for stopping said transport vehicle whereby when the transport vehicle is stopped, the rotary drive train of the powered vehicle reacts against the transmission means and propels the powered vehicle along the transport vehicle, out of said second end portion thereof and onto said track.

18. The toy as defined in claim 17 wherein said transmission means includes means for operatively engaging the powered vehicle's rotary drive train while holding said at least one driven wheel of the powered vehicle raised off of the support surface of the transport vehicle.

19. The toy as defined in claim 17 wherein said transmission means includes means for operatively engaging the powered vehicle's rotary drive train and holding said pair of driven rear wheels of the powered vehicle raised off of the support platform of the transport vehicle while the front wheels of the powered toy vehicle remain engaged with the platform.

20. A toy for use with a powered toy vehicle having a plurality of wheels, a power source, and a rotary drive train for the vehicle including at least one of said wheels; said toy including a transport vehicle having a powered vehicle support surface, at least one drive wheel for drivingly engaging the surface on which the transport vehicle is placed and drive transmission means for operatively engaging a predetermined portion of said powered vehicle's rotary drive train to transmit power from said drive train to the at least one drive wheel of the transport vehicle when the powered vehicle is in a predetermined position on said support surface; a track section having first and second end portions; said transport vehicle being located in said track section for movement between said end portions thereof; whereby when said transport vehicle is located in said track section adjacent said first end portion thereof a powered vehicle adjacent said first end portion of the track section can move directly onto the support surface of the transport vehicle; said transport vehicle including means for stopping said powered vehicle in said predetermined position with said powered vehicle's rotary drive train engaged with said transmission means to drive the at least one drive wheel of the transport vehicle and move the transport vehicle from said first end portion of the track section to said second end portion; said track section including means adjacent the second end portion thereof for stopping said transport vehicle whereby when the transport vehicle is stopped, the rotary drive train of the powered vehicle reacts against the transmission means and propels the powered vehicle along and out of the transport vehicle.

21. A toy for use with a powered toy vehicle having front wheels and a pair of driven rear wheels for driving against a supporting surface to propel the powered vehicle thereover, and a rotary drive train including said driven rear wheels, said toy including a track providing a vehicle support surface defining a path of travel for such vehicles, said track including a track section having an elongated well formed therein extending along a portion of said path of travel between first and second positions in the well, a transport vehicle positioned in said well and having a pair of track engaging wheels rotatably mounted therein and a vehicle support platform located at substantially the same elevation as the vehicle support surface of said track; said transport vehicle including drive transmission means for operatively engaging said rotary drive train of the powered vehicle to transmit power from said drive train to said pair of track engaging wheels when said powered vehicle is in a predetermined position on the support surface of the transport vehicle, and means on said transport vehicle for stopping movement of said powered powered vehicle on the support platform of the transport vehicle beyond said predetermined position, when said transport vehicle is in said first position, thereby causing said transmission means and said one pair of track engaging wheels to rotate and move the transport vehicle, and toy vehicle thereon, along said elongated well to said second position; said track section including means adjacent said second position in the well for stopping said transport vehicle whereby when the transport vehicle's rotation of said one pair of track engaging wheels is stopped and the rotary drive train of the powered vehicle reacts against the transmission means to propel the powered vehicle along the support platform of the transport vehicle.

* * * * *